US009662660B2

(12) United States Patent
Zimmerman et al.

(10) Patent No.: US 9,662,660 B2
(45) Date of Patent: May 30, 2017

(54) MOBILE SIZER WITH INTEGRATED LOAD BUCKET

(71) Applicant: Joy MM Delaware, Inc., Wilmington, DE (US)

(72) Inventors: Joseph J. Zimmerman, Franklin, PA (US); Andrew W. Struthers, Jackson Center, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 516 days.

(21) Appl. No.: 14/224,550

(22) Filed: Mar. 25, 2014

(65) Prior Publication Data

US 2014/0284409 A1 Sep. 25, 2014

Related U.S. Application Data

(60) Provisional application No. 61/805,009, filed on Mar. 25, 2013.

(51) Int. Cl.
*B02C 21/02* (2006.01)

(52) U.S. Cl.
CPC ..... *B02C 21/026* (2013.01); *B02C 2021/023* (2013.01)

(58) Field of Classification Search
CPC .. B02C 21/026; B02C 2021/023; B02C 21/02
USPC ..... 241/101.763, 101.742
See application file for complete search history.

(56) References Cited

U.S. PATENT DOCUMENTS

| | | | |
|---|---|---|---|
| 3,072,257 | A | 1/1963 | Hockenberry |
| 3,406,851 | A | 10/1968 | Sundberg |
| 3,443,704 | A | 5/1969 | Eriksson |
| 3,461,968 | A | 8/1969 | Longley |
| 3,732,980 | A | 5/1973 | Evers et al. |
| 3,738,513 | A | 6/1973 | Wagner |
| 3,765,490 | A | 10/1973 | Logue |
| 4,676,688 | A | 6/1987 | Caradot |
| 4,881,691 | A | 11/1989 | Oldengott et al. |
| 4,953,915 | A | 9/1990 | Jasser et al. |
| 5,054,958 | A | 10/1991 | Strunk |
| 5,560,551 | A | 10/1996 | Suverkrop |
| 5,682,953 | A | 11/1997 | Buysse |
| 6,041,866 | A | 3/2000 | Smith |

(Continued)

FOREIGN PATENT DOCUMENTS

| | | | |
|---|---|---|---|
| CN | 102143900 | A | 8/2011 |
| CN | 103097659 | A | 5/2013 |

(Continued)

OTHER PUBLICATIONS

PCT International Search Report and Written Opinion for PCT Application No. PCT/US14/31704 dated Aug. 22, 2014 (17 pages).

(Continued)

*Primary Examiner* — Mark Rosenbaum
(74) *Attorney, Agent, or Firm* — Michael Best & Friedrich LLP

(57) ABSTRACT

A mobile sizer for an underground mining system includes drive treads, a sizer portion mounted on the drive treads, and a load bucket pivotably coupled to the sizer portion. The load bucket is sumped to remove material from the mine and pivotably swung to transfer removed material to the sizer portion.

22 Claims, 5 Drawing Sheets

(56) References Cited

U.S. PATENT DOCUMENTS

| | | | | |
|---|---|---|---|---|
| 7,470,100 | B2 | 12/2008 | Hackett et al. | |
| 7,494,314 | B2 | 2/2009 | Bares et al. | |
| 7,588,204 | B2 | 9/2009 | Douglas et al. | |
| 8,322,643 | B2 | 12/2012 | Gervais et al. | |
| 2001/0020656 | A1 | 9/2001 | Frick | |
| 2010/0275472 | A1 | 11/2010 | Cunningham | |
| 2011/0174907 | A1 | 7/2011 | Davis et al. | |
| 2011/0278384 | A1* | 11/2011 | Ange, III | B02C 23/02 241/25 |
| 2012/0007413 | A1 | 1/2012 | Zimmerman | |
| 2012/0018557 | A1 | 1/2012 | Hubrich et al. | |
| 2012/0175287 | A1 | 7/2012 | Sauser et al. | |

FOREIGN PATENT DOCUMENTS

| | | | |
|---|---|---|---|
| DE | 3501509 | C2 | 9/1995 |
| WO | 2012006559 | A1 | 1/2012 |

OTHER PUBLICATIONS

Office Action from the State intellectual Property Office of the People's Republic of China for Application No. 201480025481.X dated Oct. 17, 2016 (7 pages).

* cited by examiner

MOBILE SIZER WITH INTEGRATED LOAD BUCKET

BACKGROUND

In underground hard-rock mining, a process called block caving can be used. In this process, an ore body is typically preconditioned by fracturing the ore via various methods, e.g., hydro-fracturing. Conical or tapered voids are then drilled at the bottom of the ore body, and the void is blasted. The fractured ore body above the blast will cave, and, through gravity, fall or settle down into collection areas called draw-bells. The draw-bells serve as discharge points to an entryway. Load-haul-dump vehicles typically tram through the entryway to load ore from the draw-bell. The vehicles haul the ore through various other entryways to a centrally-located dump point and dump the ore into an underground crusher that has been installed at the dump point. The crushed ore subsequently is fed to a conveyor system to be conveyed out of the mine. As additional ore is removed from the draw-bells, the ore body caves in further, providing a continuous stream of ore.

SUMMARY

In some embodiments, a mobile sizer for an underground mining system includes drive treads, a sizer portion mounted on the drive treads, and a load bucket pivotably coupled to the sizer portion. The load bucket is pivotably swung to transfer removed material to the sizer portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
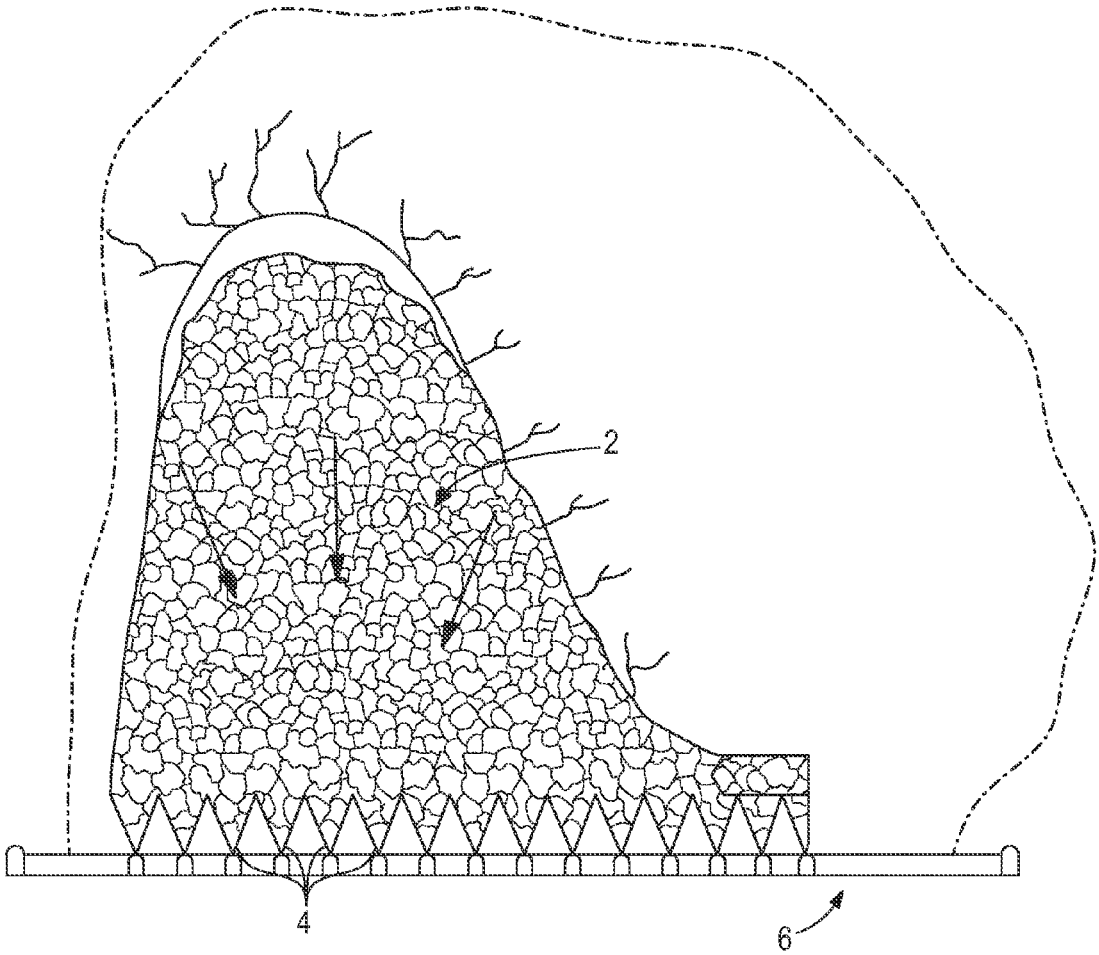
FIG. 1 is a schematic diagram of a block caving mining setup depicting an ore body, draw-bells, and undercut entryways.

FIG. 1 illustrates an underground block-caving mining process, where fractured ore body or material 2, such as copper or gold ore, caves and falls by gravity toward a series of draw-bells or draw points 4. The draw-bells 4 are discharge points to roadway entries or extraction drives 6 that extend below the fractured ore body 2 and lead to other underground entries that permit material extracted from the draw-bells 4 to be transported to the surface. A block-caving infrastructure typically includes a plurality of draw-bells 4 distributed through a mining block. The block-caving infrastructure can be several hundred or several thousand meters underground. Each roadway entry 6 leads to a dump point, which in turn leads to other entries that allow material removed from the draw-bells 4 to be transported to the surface.

Figure 2:
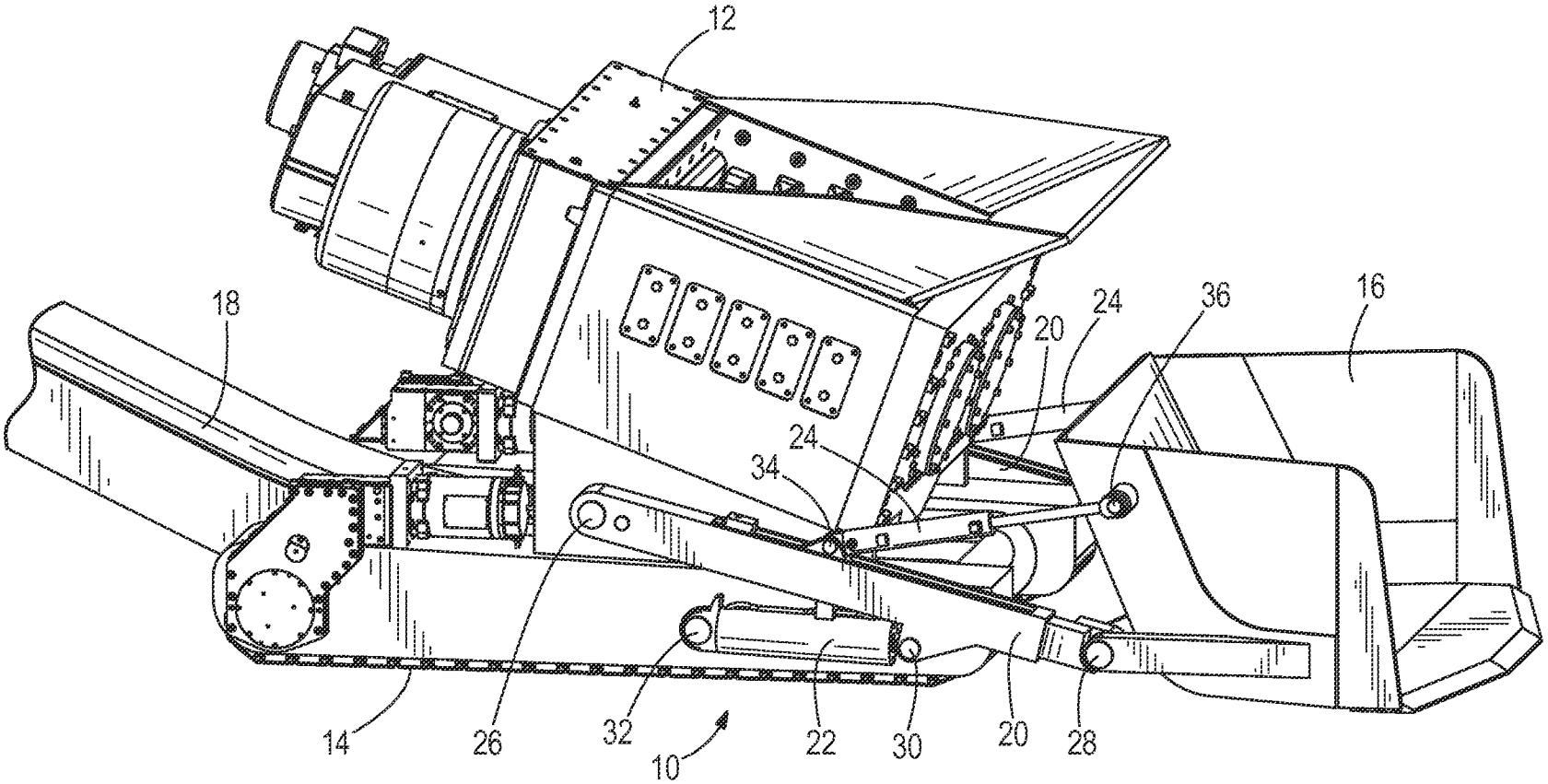
FIG. 2 is a perspective view of a mobile sizer including a load bucket according to one embodiment of the invention.
Figure 3:
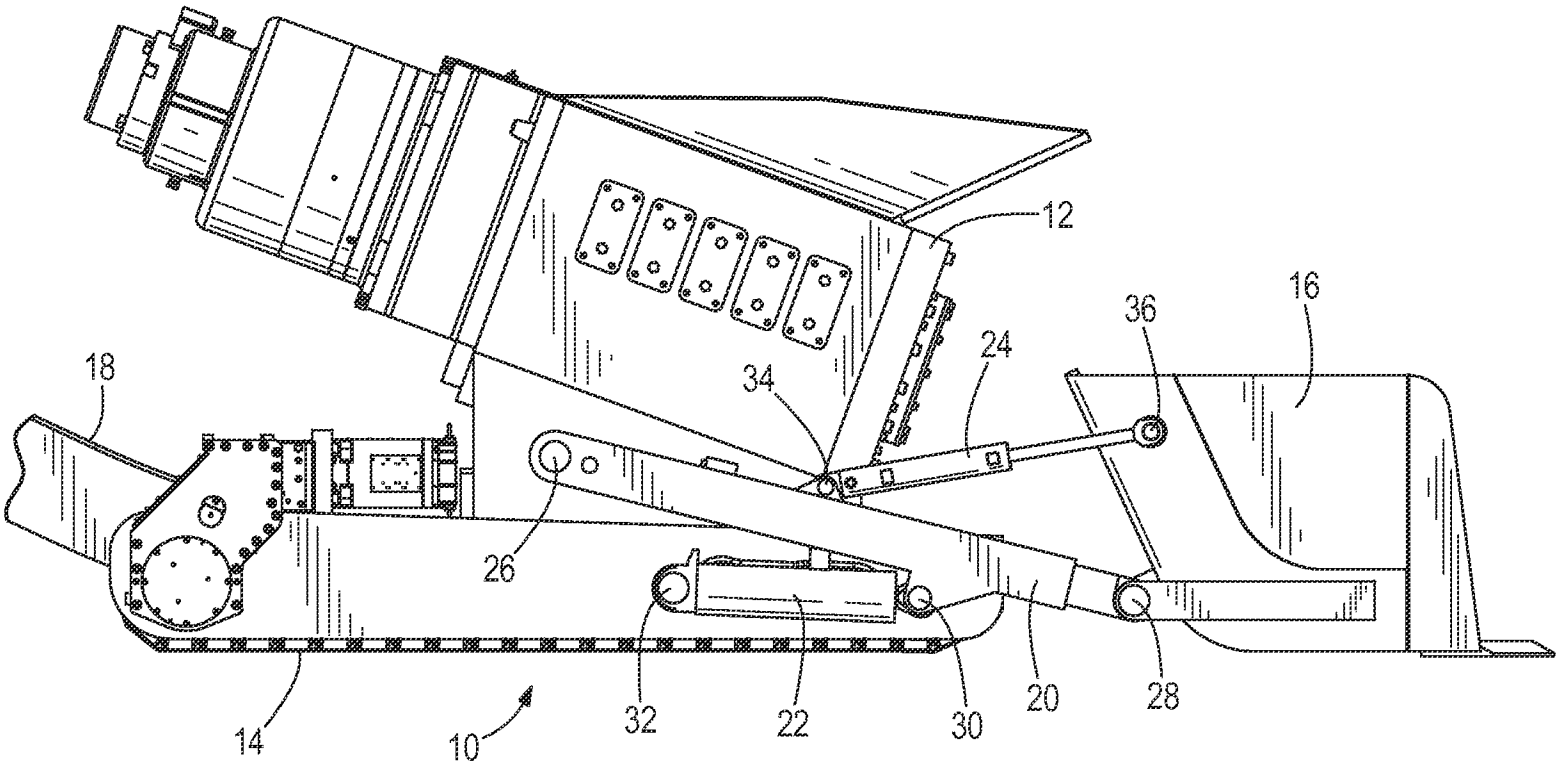
FIG. 3 is a side view of the mobile sizer of FIG. 2.

Referring also to FIGS. 2 and 3, a mobile sizer 10 is movable along the roadway entries 6 for removing fracture ore or material 2 from the draw-bell 4, and sizing the removed material. The sized material may be discharged to a material collector or haulage vehicle (not shown). The illustrated mobile sizer 10 comprises a sizer portion 12 that is mounted on drive treads 14, and a load bucket 16 pivotably coupled to the sizer portion 12. Although in the illustrated embodiment the mobile sizer 10 includes the drive treads 14, other embodiments can include track-type crawlers, rubber-tired wheels, or substantially any other type of support that allows for movement of the mobile sizer 10. The load bucket 16 includes a hollow bucket body for collecting the removed material. The collected material is dumped from the load bucket 16 to the sizer portion 12, as explained below. One or more cylindrical rollers with associated bits are mounted in the sizer portion 12 and size or crush the material 2. The sized material is deposited from the sizer portion 12 onto a discharge conveyor 18, which carries or conveys the sized material generally upwardly from a location proximal to the mine floor to a position substantially elevated relative to the mine floor. The discharge conveyor 18 can employ a plate-type conveyor, an armored-face conveyor, an endless-belt type conveyor, or other conveyors that are known in the art.

The mobile sizer 10 includes a power supply or drive mechanism (not shown) for moving the mobile sizer 10 along the roadway entries 6 from one draw-bell 4 to another and powering on-board controllers and motors. Thus, the mobile sizer 10 is movable along the mine floor and can be positioned anywhere along the length of the roadway entries 6. The mobile sizer 10 can be driven or powered by electrical, electro hydraulic, or a combination of electric and hydraulic motors, and in some embodiments may be powered at least in part by diesel power. In further embodiments, movement of the mobile sizer 10 is controlled by an automated system using inertial or other types of navigation or guidance.

In the illustrated embodiment, a pair of first coupling members or booms 20 extends between the sizer portion 12 and the load bucket 16. A pair of second coupling members 22 each extends or branches from a corresponding first coupling member 20 for pivotably coupling to the sizer portion 12, and a pair of third coupling members 24 each extends or branches from a corresponding first coupling member 20 for pivotably coupling to the load bucket 16. The illustrated second and third coupling members 22, 24 extend from opposite sides of the first coupling member 20 away from each other. The first coupling members 20 are each pivotably coupled to the sizer portion 12 and load bucket 16 at corresponding pivot joints 26, 28. The second coupling members 22 are each pivotably coupled to the corresponding first coupling member 20 and sizer portion 12 at corresponding pivot joints 30, 32. The third coupling members 24 are each pivotably coupled to the corresponding first coupling member 20 and load bucket 16 at corresponding pivot joints 34, 36. In the illustrated embodiment, a pair of first and second coupling members 20, 22 and a pair of first and third coupling members 20, 24 each define an acute angle. In other embodiments, each of the second and third coupling members 22, 24 can extend at a non-zero angle relative to a corresponding first coupling member 20.

In the illustrated embodiment, the first, second, and third coupling members 20, 22, 24 each include powered cylinders. The first, second, and third coupling members 20, 22, 24 are each telescopically extendable between a retracted position and an extended position. In the illustrated embodiment, the first coupling members 20 each include two weldments assembled with a hydraulic cylinder that is extendable to expand a distance between the pivot joints 26 and 28. The extended and retracted configurations may be accomplished by means of mechanical, hydraulic, pneumatic, or electric systems depending upon the capabilities and configuration of the mobile sizer 10. In some embodiments, one or more of the first, second, and third coupling members 20, 22, 24 may be automatically extendable and retractable in response to information received from various sensors, transducers, cameras, and the like.

Figure 4:
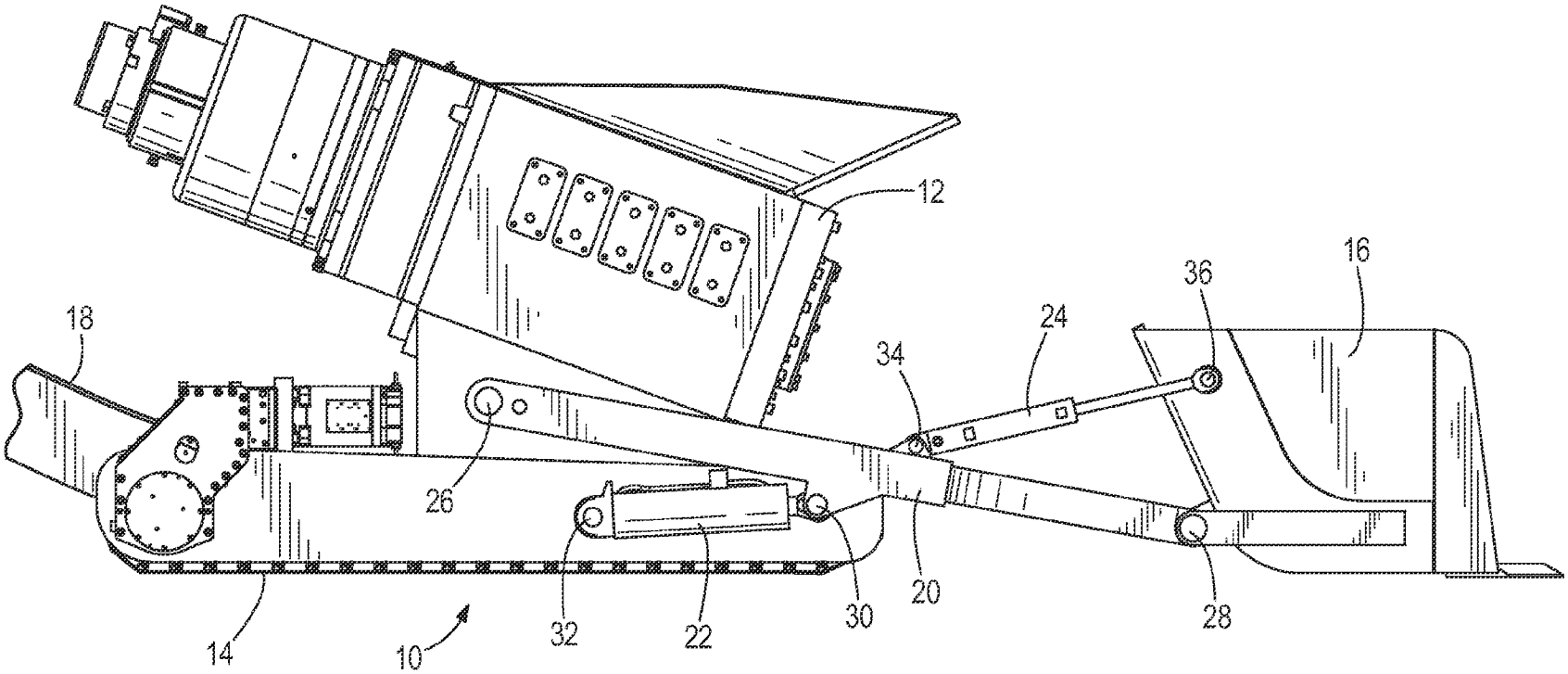
FIG. 4 is a side view similar to FIG. 3, illustrating the load bucket in an extended position.
Figure 5:
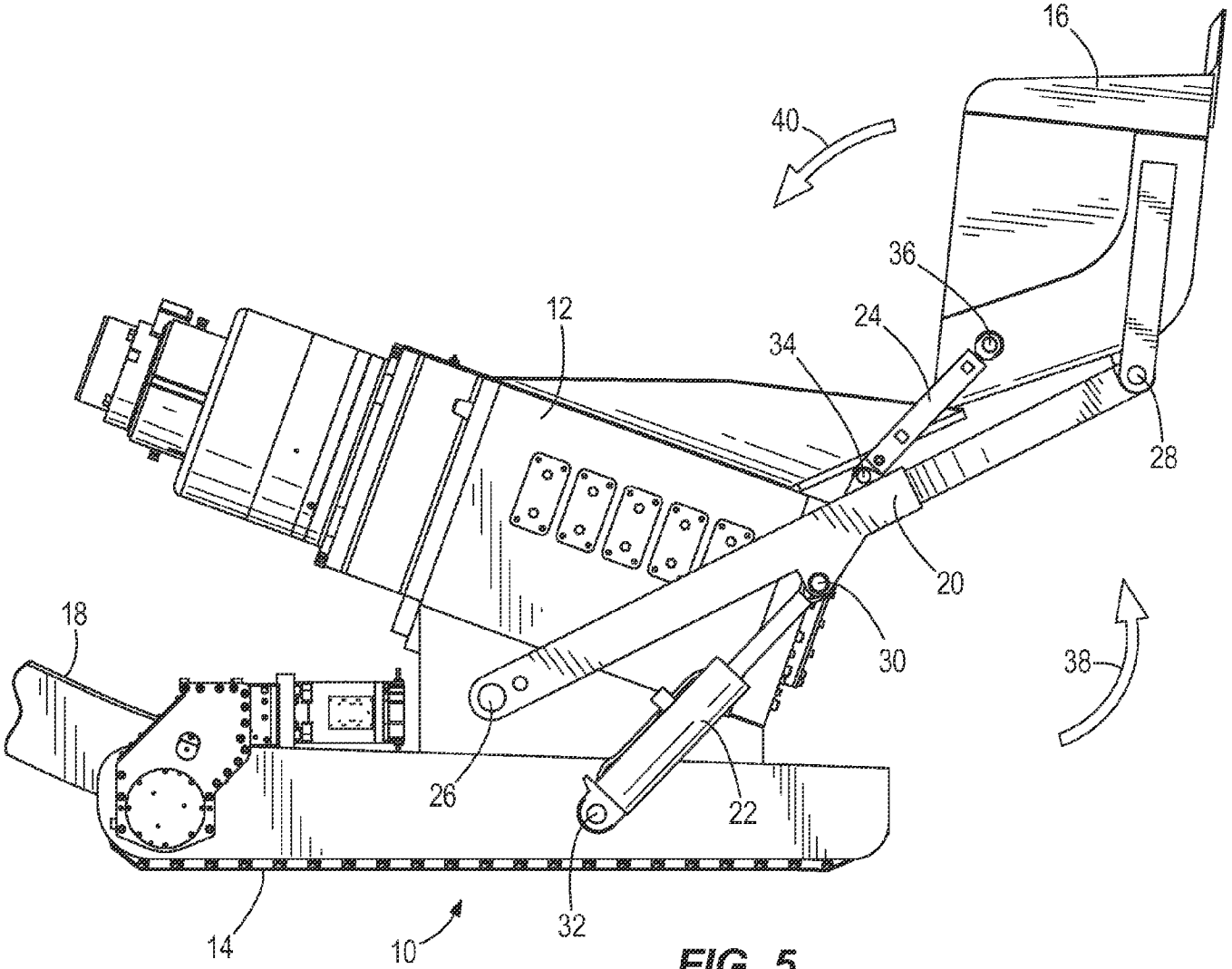
FIG. 5 is a side view similar to FIG. 4, illustrating the load bucket in a pivotably swung and tilted position.

In operation, the mobile sizer 10 trams or advances along the roadway entry 6 to a draw-bell entry. As illustrated in FIGS. 2 and 3, in this configuration, the first and second coupling members 20, 22 are in retracted positions, and the third coupling members 24 are in an extended position. Once the mobile sizer 10 is positioned at the draw-bell entry, the load bucket 16 is crowded or "sumped" into the draw-bell 4. As illustrated in FIG. 4, this is accomplished by moving the first coupling members 20 to the extended position, while maintaining the second coupling members 22 in the refracted position and the third coupling members 24 in the extended position. When the load bucket 16 has thus fully sumped into the draw-bell 4, the load bucket 16 is pivotably swung in the swing direction 38 (e.g., counterclockwise in FIG. 5) and tilted or cocked in the tilt direction 40 (e.g., counterclockwise in FIG. 5) to transfer or dump the collected material to the sizer portion 12. The pivotable swinging is accomplished by moving the second coupling members 22 to the extended position, and the tilting is accomplished by moving the third coupling members 24 to the retracted position, all while maintaining the first coupling members 20 in the extended position.

The load bucket 16 is thus operable to collect and dump the removed material 2. The dumping of the removed material 2 is via gravity and can be quick or rapid, thereby reducing the handling time of the material and potentially improving production rates. While the material is being sized, the load bucket 16 can return to the configuration illustrated in FIGS. 2 and 3 by suitably reversing the movements of the first, second, and third coupling members 20, 22, 24. The removed material can thus move from the load bucket 16, to the sizer portion 12, to the discharge conveyor 18, and eventually outside the mine, all on a substantially rapid and continuous basis. After completing an operation at a given draw-bell 4, the mobile sizer 10 can tram further along the roadway entry 6 to the next draw-bell entry. Once the mobile sizer 10 is positioned at the next draw-bell entry, the load bucket 16 is crowded or sumped into the draw-bell 4, and the material-loading process is repeated. In a block-cave infrastructure with multiple draw-bells 4, a plurality of mobile sizers 10 can be employed to improve production rates.

Known systems that utilize massive, centrally-located underground dump points with large, immovable crusher assemblies may require an infrastructure in the roadway entries 6 such as haulage conveyors or conveyor belts mounted to the mine floor or to one of the walls of the roadway entries, and associated structures. However, such haulage conveyors may undesirably limit the available space for maneuvering equipment in the underground roadway entries 6. Moreover, the haulage conveyors are susceptible to fly-rock damage from secondary blasting that occasionally takes place in the draw-bells 4. By utilizing the mobile sizer 10 with the integrated load bucket 16, at least some of the infrastructure in the roadway entries 6 can be substantially eliminated, while maintaining or improving production rates. Moreover, tram time between the draw-bell 4 and the immovable crusher assembly can be eliminated in whole or in part. Additionally, by moving the sizing/crushing operation closer to the material-loading process compared to a conventional block caving process, the removed material can be properly sized for a variety of methods to transport the material out of the mine. In some embodiments, the mobile sizer 10 disclosed herein can be used in connection with conventional drill and blast mining methods.

Some embodiments can include automation equipment operable to position the mobile sizer 10 at draw-bells 4 and to control other movements as needed. For example, remote cameras can be employed to help operate the load bucket 16, and maneuver and operate the mobile sizer 10 into the draw-bell 4 from a remote location. Radio or cable communication links can be used to a similar extent, with or without the remote operation cameras. In some embodiments, an operator for the remote operation cameras, communication links, or both, can be located underground. In other embodiments, the operator can be located above ground. An above ground operator can be many kilometers away from the mine. In yet other embodiments, the mobile sizer 10 can contain position-sensing devices for automation, remote operation, or both.

Although the invention has been described in detail with reference to certain preferred embodiments, variations and modifications exist within the scope and spirit of one or more independent aspects of the invention as described.

Various features and advantages of the invention are set forth in the following claims.

What is claimed is:

1. A mobile sizer comprising:

a sizer portion operable to move along a floor;

a load bucket pivotably coupled to the sizer portion and configured to remove material from a mine and to transfer the removed material to the sizer portion; and a first coupling member that extends between the sizer portion and the load bucket;

wherein the load bucket is configured to sump into material relative to the sizer portion by moving the first coupling member from a retracted position to an extended position to remove material from the mine.

2. The mobile sizer of claim 1, wherein the sizer portion includes a drive tread to move the sizer portion along the floor.

3. The mobile sizer of claim 1, wherein the sizer portion includes a wheel to move the sizer portion along the floor.

4. The mobile sizer of claim 1, further including a second coupling member that extends between the first coupling member and the sizer portion.

5. The mobile sizer of claim 4, further including a third coupling member that extends between the first coupling member and the load bucket.

6. The mobile sizer of claim 5, wherein the first coupling member, the second coupling member, and the third coupling member are each telescopically extendable between a retracted position and an extended position.

7. The mobile sizer of claim 6, wherein the load bucket is configured to swing relative to the sizer portion by moving the second coupling member from the retracted position to the extended position to transfer the removed material to the sizer portion.

8. The mobile sizer of claim 6, wherein the load bucket is configured to tilt relative to the sizer portion by moving the third coupling member from the extended position to the retracted position to transfer the removed material to the sizer portion.

9. The mobile sizer of claim 6, further comprising automation equipment operable to position the sizer portion and to control the movement of the first coupling member, the second coupling member, and the third coupling member.

10. The mobile sizer of claim 6, wherein the load bucket is configured to tilt and to swing relative to the sizer portion at the same time by moving the second coupling member and the third coupling member simultaneously.

11. The mobile sizer of claim 10, wherein the load bucket is configured to tilt and to swing relative to the sizer portion with the first coupling member in the extended position.

12. The mobile sizer of claim 1, further comprising a discharge conveyor coupled to the sizer portion configured to carry the sizer material generally upwardly.

13. A mobile sizer comprising:

a sizer portion operable to size removed material;

a discharge conveyor coupled to the sizer portion and operable to carry the sized material away from the sizer portion;

a load bucket pivotally coupled to the sizer portion and operable to remove material;

a plurality of coupling members interconnecting the load bucket and the sizer portion, wherein the plurality of coupling members are operable to move the load bucket relative to the sizer portion in a plurality of directions; and wherein one of the plurality of directions is a sump direction with the load bucket extending away from the sizer portion.

14. The mobile sizer of claim 13, wherein the plurality of coupling members are movable between a retracted position and an extended position.

15. The mobile sizer of claim 13, wherein one of the plurality of directions is a swing direction with the load bucket swinging around the sizer portion.

16. The mobile sizer of claim 13, wherein one of the plurality of directions is a tilt direction with the load bucket tilting relative to the sizer portion.

17. The mobile sizer of claim 13, wherein the load bucket is operable to move in the plurality of directions relative to the sizer portion simultaneously.

18. The mobile sizer of claim 13, further including a drive tread movable along a mine floor, the sizer portion coupled to the drive tread.

19. A sizer comprising:

a sizer portion operable to size removed material;

a load bucket coupled to the sizer portion and operable to remove material; and means for sumping the load bucket forward relative to the sizer portion into the material.

20. The sizer of claim 19, further comprising means for pivoting the load bucket upwards relative to the sizer portion.

21. The sizer of claim 20, further comprising means for tilting the load bucket towards the sizer portion.

22. The sizer of claim 21, wherein the means for pivoting and the means for tilting the load bucket operate simultaneously to move the material from the load bucket into the sizer portion.

* * * * *